United States Patent [19]

Davis

[11] Patent Number: 4,494,320

[45] Date of Patent: Jan. 22, 1985

[54] SHOE OUTSOLE

[75] Inventor: Howard F. Davis, New York, N.Y.

[73] Assignee: 8-Track Shoe Corp., White Plains, N.Y.

[21] Appl. No.: 442,754

[22] Filed: Nov. 18, 1982

[51] Int. Cl.[3] ..... A43B 13/00; A43B 13/04; A43B 13/20

[52] U.S. Cl. ..... 36/25 R; 36/32 R; 36/59 C; 36/103

[58] Field of Search ..... 36/32 R, 28, 25 R, 25 A, 36/59 C, 103; D2/274, 309, 310, 320

[56] References Cited

U.S. PATENT DOCUMENTS

| | | | |
|---|---|---|---|
| D. 266,371 | 10/1982 | Stubblefield | D2/320 |
| D. 266,798 | 11/1982 | Famolare, Jr. | D2/320 |
| D. 267,288 | 12/1982 | Davis | D2/320 |
| D. 267,366 | 12/1982 | Davis | D2/320 |
| D. 269,139 | 5/1983 | Stubblefield | D2/320 |
| 1,111,437 | 9/1914 | Butterfield | 36/32 R |
| 2,251,468 | 8/1941 | Smith | 36/59 C |
| 2,424,463 | 7/1947 | Hogg | 36/59 C |
| 3,114,981 | 12/1963 | Murawski | 36/32 R |
| 4,335,530 | 6/1982 | Stubblefield | 36/83 |
| 4,372,058 | 2/1983 | Stubblefield | 36/32 R |

FOREIGN PATENT DOCUMENTS

| | | | |
|---|---|---|---|
| 380848 | 12/1907 | France | 36/28 |

*Primary Examiner*—Henry S. Jaudon
*Assistant Examiner*—Steven N. Meyers
*Attorney, Agent, or Firm*—Hubbell, Cohen, Stiefel & Gross

[57] ABSTRACT

An outsole (10) for incorporation in a shoe or the like includes a generally shoe-shaped member of rubber-like material lower portion (14) contiguous with the lower surface of having an upper surface and a ground contacting bottom surface (19), the bottom surface (19) having a pair of depressed regions (21), (25) therein positioned for alignment with the heel and the ball of the foot, the bottom surface (19) surrounding the depressions (21), (25) and extending therebetween for supporting the foot about the ball and heel and in the shank region, respectively. In a preferred embodiment, the depressions (21, 25) are generally oval-shaped and concave, and generally triangular indentations (32) are formed in the bottom surface 19 on either side of the shank region (23), the ground contacting bottom surface (19) thereby presenting the general appearance of a figure eight.

4 Claims, 6 Drawing Figures

SHOE OUTSOLE

TECHNICAL FIELD

This invention relates to shoe outsoles.

BACKGROUND ART

The feet of human beings are adapted for walking on relatively soft surfaces, such as grass, rather than on extremely hard surfaces such as asphalt or concrete. Constant walking on a hard surface such as concrete or asphalt can lead to foot, back and other problems. Accordingly, it is desirable to have a shoe outsole which is able to cushion the walk of a person wearing the shoe so that the deleterious effects of constant walking on pavement are mitigated, this being especially desirable in the vicinity of the heel and the ball of the foot which bear the brunt of the impact during walking and running. It is also desirable for a shoe outsole to be designed to permit at least some air circulation between the bottom surface of the shoe sole and the ground. Such air circulation has the effect of keeping the shoed foot warm in the winter and cool in the summer. Finally, it is advantageous that the outsole be shaped so that if the shoed foot is unintentionally turned to the outside or inside, the sole tends to redirect the shoed foot back toward the correct upright position.

Lombard et al, U.S. Pat. No. 3,100,354 discloses a shoe outsole wherein a depressed region extends continuously from the toe section to the back of the heel section. The primary disadvantage of this arrangement is that no support is provided in the middle of the shoe in the region of the shank. U.S. Pat. No. 4,096,649 issued to Saurwein discloses a shoe sole having a plurality of cut-out areas defined by flanges. The flanges, which define the contact surfaces of the sole, are too thin to provide effective cushioning. Again, moreover, there is little if any support provided in the shank region. U.S. Pat. No. 3,086,301 issued to Pastor discloses an outsole construction provided with an opening in the central ball region of the foot. In use, a cover is disposed over the opening, the intent being that the central ball region rest on the cover above the opening. In this arrangement, no cushioning is provided for the heel portion of the foot. Moreover, the space defined by the opening between the ground and the cover is of uniform height, and such an arrangement may not provide sufficient support for the ball region, which may sag into the opening. U.S. Pat. No. 2,555,590 issued to Johnson discloses an outsole having a heel portion including a chamber, which is, however, closed on the bottom surface of the sole. Consequently, air circulation into the chamber through the bottom of the sole is not possible. U.S. Pat. No. 1,690,115 issued to Huestis discloses an outsole having a multiplicity of irregularly shaped cut outs in the bottom surface thereof. These cut outs, however, do not provide the desired cushioning for the heel and central ball sections of the foot. Furthermore, there is a wide transverse depression extending across the middle of the sole and hence there is no support in the vicinity of the shank.

Thus, while the prior art discloses means for achieving some of the aforementioned desired properties of a shoe outsole, no known sole achieves all of the desirable properties. Accordingly, an objective of the present invention is a shoe outsole which simultaneously achieves the above-mentioned desirable properties.

DISCLOSURE OF THE INVENTION

In accordance with the present invention, I have developed an improved outsole for incorporation in a shoe or the like. The inventive outsole comprises a generally shoe-shaped member of rubber-like material having an upper surface and a ground contacting bottom surface for engaging the ground. The bottom surface has a pair of depressed regions positioned for alignment with the heel and ball of the foot, the ground contacting surface surrounding the depressions and extending therebetween for supporting the foot about the ball and heel and in the shank region, respectively. As used herein, the term rubber-like is intended to include natural as well as synthetic materials having the general characteristics of rubber or similar materials.

Desirably, the depressed regions are substantially oval-shaped, and a pair of generally triangular indentations are formed in the lower portion of the sole on either side of the shank region, the ground engagable bottom surface thereby presenting the general appearance of a figure eight. The oval-shaped depressed regions are desirably concave with the deepest point of each region being substantially at its center. It is also desirable that the defining walls of the indentations taper upwardly and outwardly from the bottom surface to a junction with the side walls of the upper portion of the shoe-shaped member.

The preferred outsole in accordance with the invention is highly advantageous. The figure eight shaped ground engagable bottom surface provides firm support when the foot engages the ground, while the depressed regions provide cushioning for the heel and ball sections of the foot which normally receive maximum impact. Because the defining walls of the depressed regions are concave, cushioning is accomplished while at the same time providing sufficient support to prevent the heel and ball of the foot from sagging into the depressions. The depressions also allow for the circulation of air between the bottom surface of the sole and the ground. In addition, in the event, as sometimes happens, the foot turns to the outside or inside, the generally triangular indentations on either side of the shank region between the depressed regions tend to return the foot to the upright position.

Further features and advantages of the preferred outsole in accordance with the present invention will be more fully apparent from the following detailed description and annexed drawings of the presently preferred embodiment thereof.

BRIEF DESCRIPTION OF THE DRAWINGS

In the drawings, wherein like numerals represent like parts.

BEST MODE FOR CARRYING OUT THE INVENTION

Figures 1, 2, 3, 4, 5, 6:
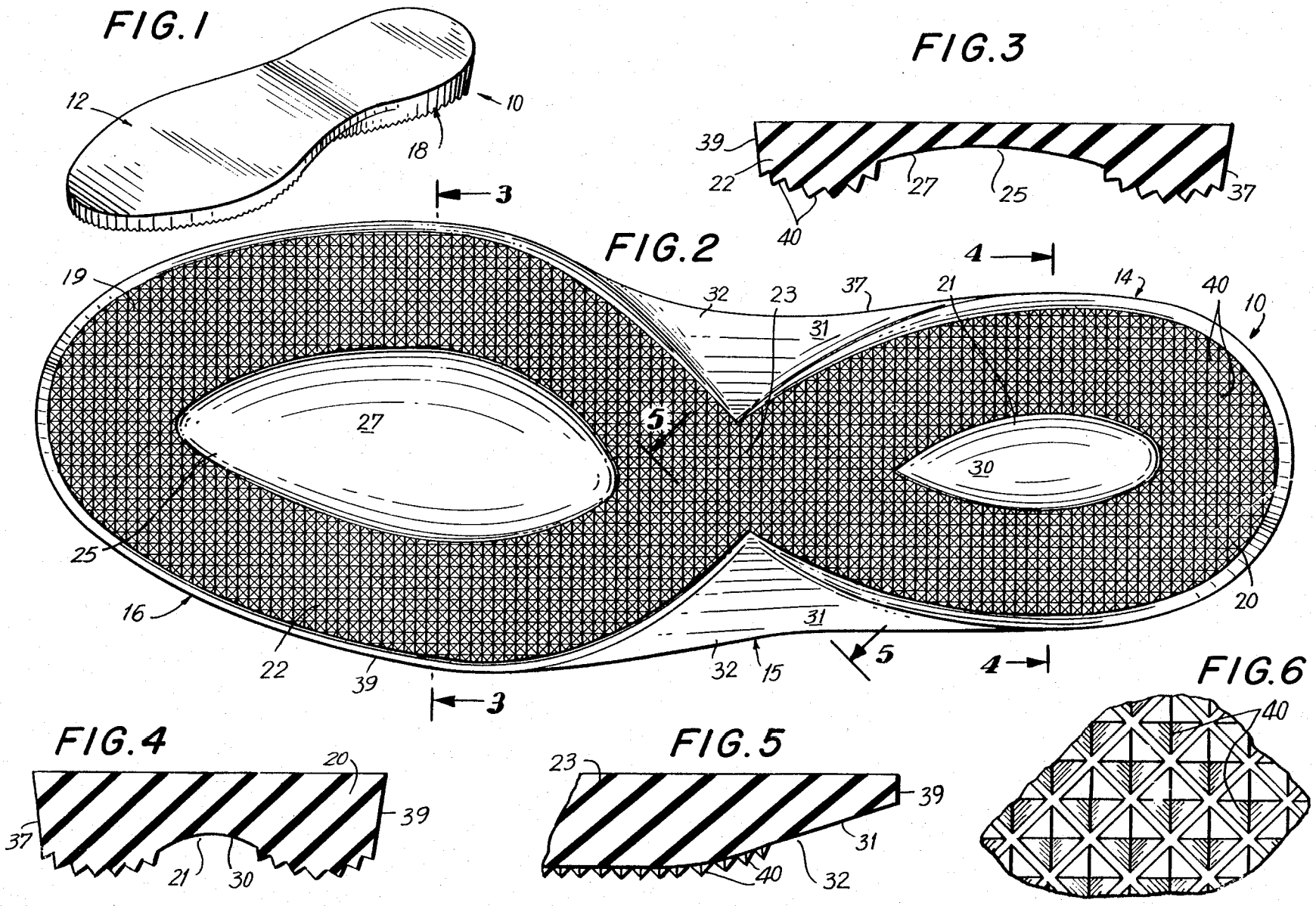
FIG. 1 is a perspective view of a shoe outsole in accordance with an illustrative embodiment of the invention.
FIG. 2 is a bottom plan view of the outsole of FIG. 1.
FIG. 3 is a cross-sectional view taken generally along the line 3–3' in FIG. 2.
FIG. 4 is a cross-sectional view taken generally along the line 4–4' in FIG. 2.
FIG. 5 is a cross-sectional view taken generally along the line 5–5' in FIG. 2.
FIG. 6 is a fragmentary enlarged bottom plan view of the outsole of FIG. 1.

Referring to the drawings, a preferred ground engagable outsole in accordance with the invention is generally designated at 10. The outsole 10 has the usual heel, shank and toe regions 14, 15 and 16, respectively.

Outsole 10 is constructed of a rubber-like material and includes an upper portion 12 in the form of a shoe shaped slab and a lower portion 18 integrally formed on the undersurface of the upper portion 12. It is the bottom surface 19 of the lower portion 18 which engages the ground when a shoe or the like incorporating the outsole 10 is worn, the shoe upper being joined to the upper surface 19 of the upper portion 12 in a manner well known to those skilled in the art.

As shown, the lower portion 18 of the sole 10 has generally oval shaped depressed regions 21, 25 formed in the heel and toe regions 14, 16 respectively. In addition, the lower portion 18 is cut away on either side of the shank region 15 thereby defining a pair of generally triangular indentations 32. Consequently, when viewed from the bottom as in FIG. 2, the bottom surface 19 of the lower portion 18 has the general appearance of a "figure eight" having a rear lobe 20 at the heel section 14 about the depression 21, a front lobe 22 at the toe section 16 about the depressions 25, and an intermediate section 23 connecting the lobes 20 and 22 which defines a shank support region. As best shown in FIGS. 3 and 4, the bottom surfaces of the lobes 20 and 22 are somewhat convex.

As shown, the depressed region 21 occupies substantially the central portion of the heel section 14, the defining wall 30 of the region 21 being generally concave such that the depression 21 is deepest near the center of the heel region 14 and shallower as the wall 30 tapers toward the figure eight shaped bottom surface 19. Similarly, the depressed region 25 occupies substantially the central portion of the toe section 16, also known as the ball region since it registers with the ball of the foot during use, the defining wall 27 of the depression 25 also being generally concave such that the depression 25 is deepest near the center of the ball region and shallower as the wall 27 tapers toward the bottom surface 19. The defining walls 31 of the pair of generally triangular indentations 32 at the shank region 15 taper outward and upward from the bottom surface 19 to a juncture with the sides 37, 39 of the upper portion 12. Desirably, and as shown, the ground engagable bottom surface 19 of the lower portion 18 is provided with a cross hatched pattern of grooves 40 cut into the surface 19 to prevent slippage when the surface 19 engages the ground during use of the sole 10.

It will now be apparent that the shoe outsole 10 in accordance with the present invention accomplishes all of the above mentioned desirable objectives. First, by providing recesses in the bottom of the sole in the areas of the ball and heel sections, cushioning of the foot at these points of maximum impact is assured. Further, by limiting the depressions to the ball and heel sections, the intermediate section of the outsole between the depresssed regions contacts the ground thereby providing support to the shank of the foot. Cutting away the intermediate portion of the outsole on either side of the shank tends to correct any tendency of the shoe to turn to the outside or inside during use. It is further noted that the depressed regions are generally concave or scooped out, such that the deepest portion of the depressed regions is substantially at their respective centers, the regions generally tapering outward and downward to the bottom surface of the outsole which, as noted, has the general appearance of a figure eight. By this arrangement maximum cushioning or shock absorbence is provided in the heel and ball sections which receive maximum impact, while at the same time providing sufficient support for the foot, thereby insuring that the heel and ball sections do not simply "sag" into the depressed regions. As a consequence of this shock absorbence, a shoe incorporating the outsole 10 is particularly comfortable during use. The depressed regions also allow air to circulate between the ground and the defining walls of the depressions which has the effect of warming the wearer's foot in the winter and cooling the foot in the summer.

While I have herein shown and described a preferred embodiment of the outsole in accordance with the present invention, it should be understood that the above description is to be construed as illustrative only, and not in the limiting sense, the scope of the invention being defined by the following claims.

What is claimed is:

1. An outsole for incorporation in a shoe or the like to be worn on the foot of a user comprising:

a generally shoe-shaped member of rubber-like material having an upper surface and a ground contacting bottom surface the ground contacting bottom surface having first and second depressed regions therein;

said first depressed region in said bottom surface being located in the real half of said shoe outsole and being of sufficient size to substantially encompass the heel of said user's foot for cushioning same upon ground impact, said first depressed region having a tapered sidewall such that said depressed region is wider at the ground contacting surface thereof than at the top for providing support to the heel of the foot sufficient to prevent excessive downward sagging thereof into said first depressed region upon ground impact;

said second depressed region in said bottom surface being located in the front half of said shoe outsole and being of sufficient size to substantially encompass the ball of said user's foot for cushioning same upon ground impact, said second depressed region having a tapered sidewall such that said depressed region is wider at the bottom thereof than at the top for providing support to the ball of the foot sufficient to prevent excessive downward sagging thereof into said second depressed region upon ground impact;

the ground contacting bottom surface surrounding said depressions and having a section extending therebetween for supporting the foot in the shank region.

2. The outsole according to claim 1, and further comprising a generally triangular pair of indentations in said bottom surface on either side of said shank supporting section.

3. The outsole according to claim 2, wherein said depressed regions are generally oval-shaped, the defining sidewalls thereof being generally concave with the deepest point of each depressed region being substantially at the center thereof, and wherein the defining walls of said indentations taper upwardly and outwardly from said bottom surface to a junction with the sidewalls of said generally shoe-shaped member, said ground contacting bottom surface having the general appearance of a figure eight.

4. The outsole according to claim 3, wherein said ground contacting bottom surface further comprises means for preventing slippage during ground engagement.

* * * * *